United States Patent [19]

Brede et al.

[11] 4,411,200

[45] Oct. 25, 1983

[54] SHORT TRAJECTORY ROUND

[75] Inventors: Uwe Brede; Horst Penner; Rudolf Stahlmann, all of Fürth; Erich Zeiher, Fürth-Vach, all of Fed. Rep. of Germany

[73] Assignee: Dynamit Nobel Aktiengesellschaft, Troisdorf, Fed. Rep. of Germany

[21] Appl. No.: 946,042

[22] Filed: Aug. 14, 1978

[30] Foreign Application Priority Data

Aug. 12, 1977 [DE] Fed. Rep. of Germany ..... 2736529

[51] Int. Cl.[3] ..... F42B 13/20

[52] U.S. Cl. ..... 102/529; 102/377; 102/521; 102/498

[58] Field of Search ..... 102/91, 56, 93, 921.1–92.7, 102/393, 501, 505, 498, 529, 351, 357, 342, 377, 378, 520–523, 502; 244/3.1

[56] References Cited

U.S. PATENT DOCUMENTS

| | | | |
|---|---|---|---|
| 221,249 | 11/1879 | Nowlan | 102/91 |
| 2,655,105 | 10/1953 | Hansche | 102/377 |
| 3,103,889 | 9/1963 | Keeney, Sr. | 102/91 |
| 3,338,167 | 8/1967 | Jungumann | 102/92.7 |
| 4,008,667 | 2/1977 | Look | 102/502 |
| 4,030,421 | 6/1977 | Litman | 102/92.3 |
| 4,140,061 | 2/1979 | Campoli | 102/529 |
| 4,215,632 | 8/1980 | Sie | 102/93 |

*Primary Examiner*—Harold J. Tudor

*Attorney, Agent, or Firm*—Antonelli, Terry & Wands

[57] ABSTRACT

A short range trajectory round having an aerodynamic resistance which sharply increases at a predetermined time after discharge of the round from a barrel of a weapon. The round includes a body having a longitudinal axis and a forward tip portion and a rear base portion with at least one segment forming a part of the body and arranged for outward movement away from the longitudinal axis. The at least one segment at least partially delimits an inner cavity within the body terminating at a predetermined distance from the tip portion, and a plunger having a forward portion and a rearward portion is disposed within the cavity and arranged for movement in the longitudinal direction of the round between at least a rearward position and a forward position. the plunger is movable to the forward position in response to the firing of the round for form-lockingly engaging the at least one segment to prevent movement of the at least one segment away from the longitudinal axis of the round thereby to establish a first aerodynamic resistance for the round. The plunger is also movable toward the rearward position after discharge of the round from the barrel of the weapon for disengaging the at least one segment to enable outward movement of the at least one segment with respect to the longitudinal axis of the round and thereby establish at least a second aerodynamic resistance for the round which is greater than the first aerodynamic resistance.

24 Claims, 4 Drawing Figures

SHORT TRAJECTORY ROUND

Figure 1:
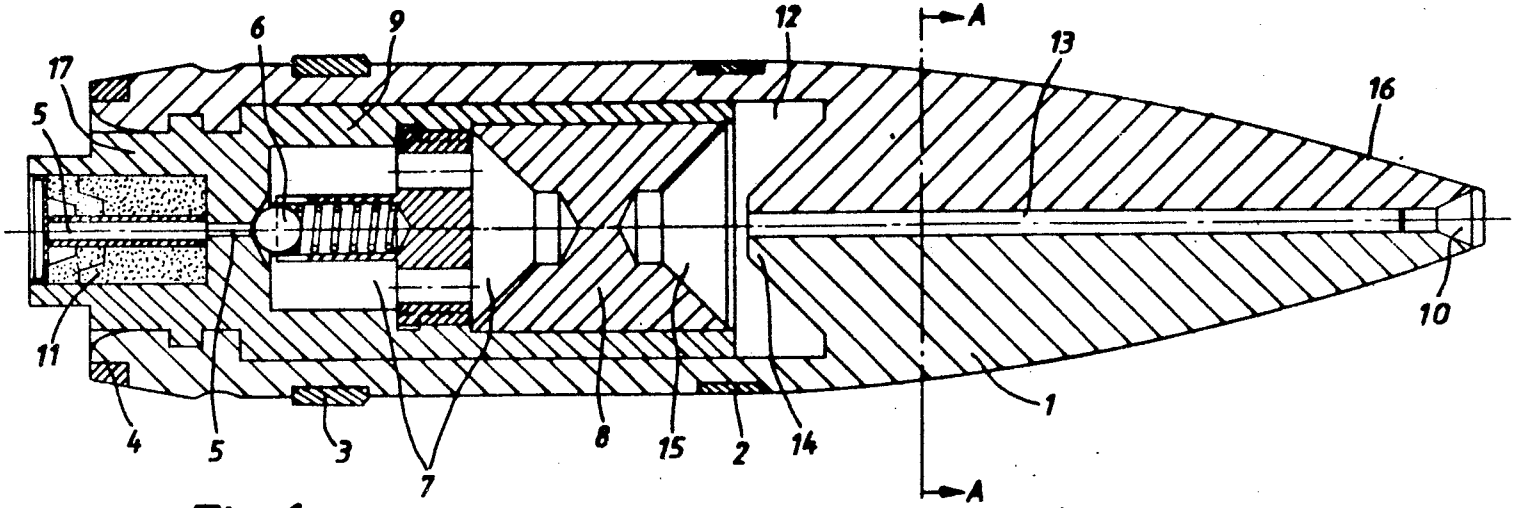

The present invention relates to a short trajectory round having an aerodynamic resistance which sharply increases a predetermined time after discharge of the round from the barrel of a weapon.

In the case of a known short trajectory round (German Pending Pat. application No. 1 578 121) of such a type, the round is divided transversely into two parts and swingout flaps are articulated on the rear part laterally and transversely to the longitudinal axis. The other ends of the flaps are held in the applied position at the forward part of the round by overlapping firing notches as long as the two round components are placed together. The two round components are forced apart after firing at a specified time by prestressed axial springs, namely at the time when the round velocity has decreased to the extent that the aerodynamic resistance force has become smaller than the spring tension and the latter can then shift to the front the forward round component. Thereupon, the brake flaps swing out and cause through the great increase in resistance the braking of the round and theby shorten the trajectory relative to the live round. Disadvantageous herewith is that it requires relatively high costs in order to exclude a failure of this braking device. In the event of a failure, this short trajectory round would have the same range as the original round and would, for this reason, no longer satisfy the safety requirements for practice firing in a terrain with a very restricted area.

There is further a short trajectory round known (DAS No. 2 155 467) which has a hood with a safety fuse which is thrown off after melting of the fuse.

This round has, up until the modification of its external geometry owing to throwing off of the hood, just like the abovementioned short trajectory round, the same or approximately the same trajectory or flight time behavior as the live round. It has the disadvantage that the period up to melting the fuse and discarding the hood which is affected by changing factors such as, for example, manufacturing irregularities in the design and arrangement of the fuse, ambient temperature, velocity, air density and raindrops, is not sufficiently adjustable so that even the end of the practice flight phase, in which the behavior of the live round is to be simulated as accurately as possible, is subject to undesired irregularities.

The task which is the basis of the invention is to produce a short trajectory round of the initially mentioned type with which the abovementioned disadvantages are avoided, with which accordingly more particularly, on one hand, the aerodynamic resistance during the practice flight phase remains unchanged in order to achieve as like as possible a trajectory and flight time as with the live round and only at the end of the practice flight path, i.e., after a specified time interval, does it become greatly increased and, on the other hand, in the case of failure, an overshot must assuredly be out of the question.

This task is solved according to the invention by a short trajectory round having an aerodynamic resistance which sharply increases a predetermined time after discharge from the gun barrel with the short trajectory round including a body with a longitudinal axis and a forward tip portion and a rear portion, at least one segment forming a part of the body and movable outwardly with respect to the longitudinal axis, the at least one segment at least partially delimiting an inner cavity terminating at a predetermined distance from the tip portion, and a plunger having a forward portion and a rearward portion being disposed within the cavity and movable in the longitudinal direction from a rearward position to a forward position in response to the firing of the round so as to form-lockingly engage the at least one segment to establish a first aerodynamic resistance for the round. At a predetermined time after discharge of the round from the gun barrel, the plunger is responsive to forces acting on its forward portion for moving toward the rear position so as to enable the at least one segment to move with respect to the longitudinal axis of the round and establish and increased aerodynamic resistance for the round. There results a short trajectory round which has at least one and preferentially several casing segments stretching in the longitudinal direction which are held together sufficiently well for storage and transport by suitable mountings, more particularly the cartridge case with each other or with the rest of the projectile body and which are supported at time of firing on the wall of the gun barrel so that the short trajectory round exits from the muzzle of the gun barrel with adjacent casing segments, i.e., in a form in which its aerodynamic resistance is relatively slight and preferentially equal to that of the original round to be simulated as the mass of the short trajectory round is also preferentially equal to that of the original round.

The short trajectory round according to the invention is preferentially spin-stabilized so that, after discharge from the gun muzzle, the at least one casing segment would, owing to the effect of centrifugal force, be hinged laterally or even expelled whereby the aerodynamic resistance of the short trajectory round would be increased considerably. The same effect would nevertheless be achieved in a nonspin-stabilized round, for example, by utilizing the dynamic pressure of the oncoming air flow which exercises a correspondingly great radial force on at least one casing segment through a sufficiently large axial canal extending from the tip of the round to the cavity.

This hinging or discarding of the one or more casing segments is now prevented according to the invention by a locking mechanism which is only set in operation by the firing and again ceases to operate after a specified adjustable flight time. The elements causing the increase in resistance are, in the case of the round design according to the invention, first of all locked upon firing by the plunger shoved in its forward position while still in the gun barrel and after a specified flight time again unlocked by the contrary-acting process. If the locking mechanism fails, there results the severe increase in resistance upon firing the short trajectory round owing to spreading of the one or more casing segments directly after leaving the gun barrel or owing to disintegration into its individual components after discharge from the gun muzzle. For a longer flight path, an inoperation function of the locking mechanism is absolutely necessary which, however, simultaneously guarantees its out-of-operation function and thereby the effectiveness of the device according to the invention because it involves therewith the same process only directed in the opposite direction.

The shift of the plunger into its forward locking position can, for example, take place by means of gas from a compressed gas cartridge which is installed in the cavity behind the plunger which, owing to the acceleration at firing, is shoved against an impact bar installed firmly behind it and thereby is opened. Preferentially, the propellant gases of the firing propellant charge are themselves used for the shove forward of the plunger and its fixing in the forward position while these gases flow into the cavity through at least one recess connecting the base surface of the round with the cavity. After filling the cavity with the propellant gases, the recess is closed, for example with a self-actuating check valve. This backward compression force acting on the plunger is now temporarily degraded on a controlled basis, for example by the intentional cooling down of the hot propellant charge gases. If, on the other hand—as already stated above—the dynamic pressure of the air onflow in the cavity in front of the plunger takes effect, it follows that after a certain time the plunger will be shoved to the rear from its forward position and release therewith at least one casing segment so that this can make transition into the aerodynamically unfavorable position. The time of this unlocking can be adjusted by the abovementioned parameters corresponding to the actually required end of the practice flight phase. The locking between the plunger and the one or more casing segments can take place, for example, by the plunger catching with pin-type axial extensions in the corresponding recesses in its casing segments featuring parts extending into the cavity.

In a suitable embodiment of the invention, it is provided to assemble the projectile body from casing segments which mutually contact one another—considered in cross section—and between which is formed the central cavity for receiving the locking plunger. Thereby is received an especially strong resistance change, be it at the end of the practice flight phase or—in case of failure of the locking mechanism by nonoperation—after exit from the weapon.

The further flight path subsequent to the practice flight phase is thereby quite short so that the practice firing is also possible without safety risk in a terrain with very limited range.

In order to provide the round with a greater inherent stability in the practice flight phase or in the case of a like stability to be able to design more simply the plunger locking of the casing segments, there is provided a mounting, for example a common carrier plate on which the casing segments are attached through hinges or predetermined break points, which enables after end of the practice flight phase or in the case of a functional disturbance of the plunger locking mechanism after exit from the gun muzzle, the lateral spreading or discarding of the casing segments.

The short trajectory round according to the invention is preferentially spin-stabilized. In order to effect the unlocking at the end of the practice flight path, it is shown to be especially advantageous to use the very great centrifugal forces conditioned by the spin for the shoving back of the plunger. The touching sides of the extension of the casing segments and the opposite sides of the plunger are—considered in cross section—preferentially straight and designed tilted to the longitudinal axis so that they behave like wedge surfaces. Sides and/or opposite sides can, however, also be given a curved design whereby the inclination of the tangent in the contact point of the two sides with respect to the longitudinal axis determines the quantity of the force component exerted to the rear in the longitudinal direction. Owing to the extension featuring the preferentially wedge-shaped sides and which is formed on the forward end of the cavity preferentially by the several casing segments of the round, it is possible, as a result of the casing segments seeking to come apart as a result of centrifugal forces, to force back the plunger which first held them together from the start of the firing owing to action on the recess of the plunger featuring similarly wedge-shaped opposite sides. The time at which the casing segments force back the plunger against the pressure of the gases acting on it after firing can accordingly be accurately and reliably adjusted by a corresponding measurement of the inclination of the mutually touching surfaces and the pressure built up on the back side of the plunger.

In the case of an embodiment wherein a sleeve lines the cavity, the easy displaceability of the plunger and the pressure buildup behind its rear end is especially guaranteed. Preferentially, the plunger is shoved into the forward position upon firing owing to the propellant gases acting upon it while the round is provided with at least one bore connecting the base of the round with the cavity.

The time until initiating the change in resistance, i.e., until release of the one or more casing segments by the plunger, can be extended through the installation of a pressure reservoir space in the cavity at the rear of the plunger as well as through the installation of a valve for sealing the intake of the pressure reservoir space. A good time control can also be achieved by a controlled flowoff of the pressure gases via at least one flowoff canal allowing time-controlled flowoff of gases from the area behind the plunger; while, for example, the cavity is connected with the base of the round by an axial choke bore.

The invention also provides for at least one strap preferably consisting of plastic surrounding at least one casing segment on the circumference for ensuring the holding together of the round or its casing segments during assembly as well as transport and storage insofar as no mounting is provided by means of which the casing segments are at least provided with an overlapping cartridge case for a part of their length. These straps are destroyed owing to the effect of the radial force, more particularly the centrifugal force, breaking apart the casing segments in contrast to the brackets made of suitably solid material such as, for example, steel which holds together the casing segments in the area of the base of the round even after firing and from which the casing segments swing out or drop out in the case of non operation of the locking device.

According to a feature of the invention, an auxiliary charge arranged in the cavity reinforces the pressure supplied by the propellant gases for generating pressure for locking or pressure of the plunger against the extension.

This is, for example necessary in cases when—depending on caliber of the round in connection with the required practice flight behavior—the round is stabilized over a wide range of revolutions so that extraordinarily great centrifugal forces appear. The auxiliary charge generates in the pressure reservoir space an additional pressure whereby it is preferentially ignited by the propellant charge through the recess in the base of the round.

A further capability for influence and adjustment is supplied by the provision of an axial canal passing from the tip of the round to the cavity by means of which it is possible to achieve the opposite effect of the auxiliary charge. The dynamic pressure acting on the front surface side of the plunger through the axial canal accelerates the moving back of the plunger and the subsequent unfolding or discarding of the individual casing segments of the round.

In the case where a removable sealing element is provided in the axial canal at the tip, there results in an especially advantageous way a closed form of the round and a protection against the penetration of humidity and contamination into the round.

The extension or seat constructed on the casing segments and the similar recess of the plunger can feature as desired a shape resulting in a wedge effect, for example, a truncated shape or frustrum of a truncated pyramid.

Figure 1A:
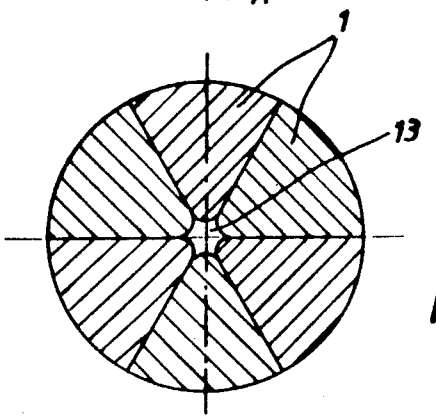
Figure 2:
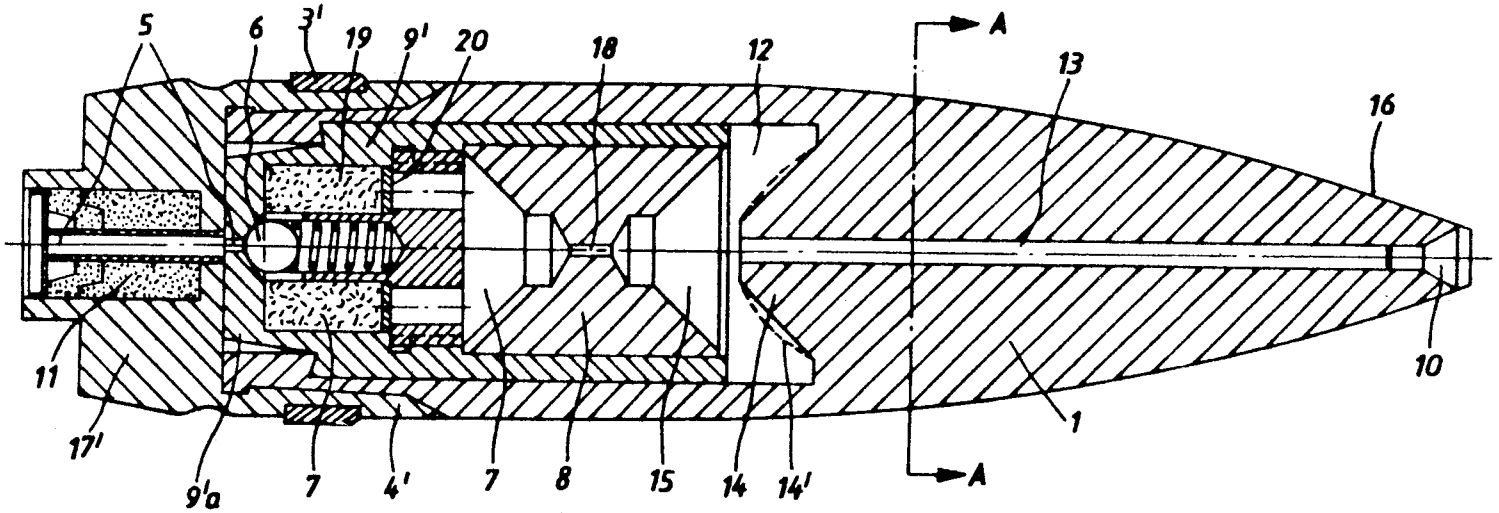
Figure 2A:
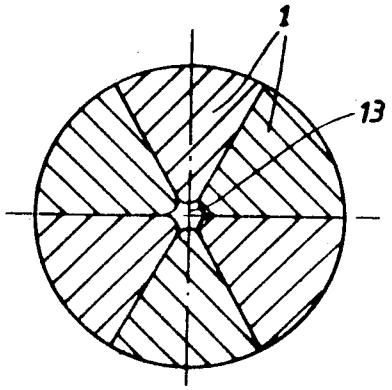

The invention is explained more in detail in the following on the basis of two embodiments with reference to the drawing, wherein FIG. 1 is a longitudinal section through one embodiment of the short trajectory round;

FIG. 1*a* is a cross section through the round of FIG. 1 in plane A—A,

FIG. 2 is a longitudinal section through another embodiment of the short trajectory round; and FIG. 2*a* is a cross section through the round of FIG. 2 in plane A—A.

In the figures, the same reference numbers indicate the same parts.

As the figures show, the round features six casing segments 1 whose arrangement is shown by FIGS. 1*a* or 2*a* as the case may be. The arrangement is selected such that an unfolding or discarding of the casing segments away from the round axis is possible. The ring-shaped straps 2 and 3 are made of plastic such as polyethylene or polytetrafluoroethylene and are destroyed at the time of the intentional breaking up of the round. The rear strap 3 is used here simultaneously in a conventional way as driving band in the gun barrel. It can also be produced, for example, from brass or steel whereby its stability, however, may only be so great that it is ruptured in the case of intentional folding or discarding of casing segments 1. The casing segments 1 enclose cavity 12. They limit the latter at its forward end by the forward projecting extension or seat 14 for a plunger 8 which can be moved back and forth in it in an axial direction. The seat 14 is constructed in truncated form and fits into a similarly constructed recess 15 at the forward face side of plunger 8. The plunger 8 does not sit directly in cavity 12 but in a sleeve 9 lining cavity 12. The sleeve 9 has at its back end a base which is broken up by an axial recess 5 produced as a borehole which leads to the outside through the floor of the round 17. In a forward direction, the sleeve 9 features an opening ending directly before the farthest rear point of seat 14. Through this opening, it is possible to move plunger 8 forward and against seat 14 in its forward position.

The pressure reservoir space 7 is located in sleeve 9 at the back side of plunger 8. The intake of pressure reservoir space 7 formed by the outlet of borehole 5 is sealed by the spring-loaded ball of a check valve 6.

In the area of the base of round 17, the casing segments 1 are enclosed in FIG. 1 by a ring-shaped bracket 4 made, for example, from steel. Further, it is possible to accommodate the tracer 11 in the base of round 17 for tracking the trajectory. A central canal 13 from the tip 16 of the round to seat 14 is left by the casing segments. This canal is sealed at the tip of the round by a sealing element 10.

The operation of the short trajectory round is as follows: During storage and transport, the casing segments 1 of the cartridge case not shown are held together by straps 2 and 3 and bracket 4. Upon firing, the propellant gases force through borehole 5 and the check valve 6 opening into the pressure reservoir space 7 and move plunger 8 with its recess 15 from the rear position shown into its forward position against seat 14 after overcoming the forces of inertia. This takes place while still within the gun barrel so that the round or its casing segments 1 are held together when leaving the gun barrel by plunger 8. The bracket 4 takes over the cohesion of the round as second locking element in addition to plunger 8 after leaving the gun barrel during the practice flight path and prevents the attempts to break up of the casing segments 1 at the rear end conditioned by the centrifugal forces.

Owing to the spin of the round, casing segments 1 are exposed to strong centrifugal forces which seek to press back plunger 8 through the wedge surfaces of seat 14 or recess 15. This is prevented by the pressure of the propellant gases in the pressure reservoir space 7 until such time as the pressure in the pressure reservoir 7 has again sufficiently dropped, for example owing to a cooling off of the propellant gases in this space or also owing to a partial flowing out from this space, for example through an intentional residual lack of tightness of check valve 6. In addition, a combination of these effects can result by suitable design measures.

As soon as plunger 8 no longer experiences from the pressure reservoir space 7 a sufficiently great counterforce against the forces of casing segments 1, it is forced back from its forward form-locking position and the casing segments 1 fold back after destruction of straps 2 and 3 in a star-shape from the longitudinal axis of the round outward around bracket 4 acting as hinge and drop off. The casing segments as well as the remaining round components then no longer have any ballistic flight properties and spin to earth on a very short flight path. The forced-back condition of plunger 8 can, if necessary, be additionally supported by the dynamic pressure building up in the axial canal 13 when the sealing element 10 is lacking or is destroyed during flight.

In the event of a failure of the braking service, for example owing to defect in the check valve 6 or such like, plunger 8 is not moved forward and does not come in contact with seat 14. In this case, the round breaks up directly after leaving the gun barrel. An overshot cannot occur.

The short trajectory round according to the invention is accordingly constructed from individual components which preferentially are only mechanically closely connected in combination with the cartridge case and during the phase of passage through the barrel and are held together after exit from the gun barrel according to the invention by means of a special locking mechanism and only for a specific practice distance (flight time). The advantage of this diagrammatic solution lies in the fact that, in the case of a failure of the locking mechanism, the round does not remain as a compact construction unit but increases its cross section by spreading out the one or more casing segments and even breaks up into its individual parts. In the case of failure of the switching mechanism, an overshot is safely ruled out of the question. This general principle can be used both for standard caliber, supercaliber as well as subcaliber with short trajectory rounds provided with discarding sabot.

In the case of the embodiment shown in FIG. 2, the difference with respect to FIG. 1 consists in that the casing segments 1 are held by their enclosing wall 4' of base of round 17' developed as discarding sabot. Correspondingly, the sleeve 9' is a separate part of base of round 17'. In order that the casing segments 1 can also fold out laterally here from the round axis, the base of sleeve 9' is tapered to the outside to the rear in a truncated shape or in a similar way so that there is space available for a movement of the corresponding base parts of the casing segments 1 against these outside surfaces 9'a of case 9'.

For the controlled outflow of propellant gases from the pressure reservoir space 7, the plunger 8 is provided with the central axial choke bore 18 so that the gases can escape forward on a delayed basis and indeed through canal 13 or the slots to the side between neighboring casing segments 1.

In the rear area of the pressure storage space 7 is further schematically indicated the auxiliary charge 19 from, for example, nitrocellulose powder or a pyrotechnical mixture generating a pressure gas whereby the space section forward is closed off by means of the destructible cover 20 made of, for example, paper. A curved side development of seat 17 is indicated by the dashed lines 14'.

The discarding sabot 17 constructed as a stub casing features the driving band 3' which does not need to be destroyed when breaking apart the round so that its stability can be specified exclusively in accordance with the required driving behavior in the gun barrel.

We claim:

1. A short range trajectory round having an aerodynamic resistance which sharply increases at a predetermined time after discharge of the round from a barrel of a weapon comprising a body having a longitudinal axis and a forward tip portion and a rear base portion, at least one segment means forming a part of the body, at least a portion of the at least one segment means being arranged for outward movement away from the longitudinal axis, the at least one segment means at least partially delimiting an inner cavity within the body terminating at a predetermined distance from the tip portion, and plunger means having a forward portion and a rearward portion disposed within the cavity and arranged for movement in the longitudinal direction of the round between at least a rearward position and a forward position, the plunger means being movable to the forward position in response to the firing of the round for form-lockingly engaging the at least one segment means to prevent movement of the portion of the at least one segment means away from the longitudinal axis of the round thereby to establish a first aerodynamic resistance for the round, the plunger means being movable toward the rearward position in response to a force acting on the forward portion thereof after discharge of the round from the barrel of the weapon for disengaging the at least one segment means to enable outward movement of the portion of the at least one segment means with respect to the longitudinal axis of the round and thereby establish at least a second aerodynamic resistance for the round which is greater than the first aerodynamic resistance.

2. A short range trajectory round according to claim 1, wherein the plunger means is responsive to gases generated upon the firing of the round and acting upon the rearward portion of the plunger means for movement from a rearward position into a forward position to form-lockingly engage the at least one segment means, the plunger means being movable from the forward position in response to the force acting on the forward portion thereof being greater than the force acting on the rearward portion thereof.

3. A short range trajectory round according to claim 2 wherein the body is formed of a plurality of segment means which delimit the cavity.

4. A short range trajectory round according to claim 2, further comprising mounting means for engaging the at least one segment means at a rear portion of the at least one segment means to permit outward movement of the portion of the at least one segment means with respect to the longitudinal axis of the round.

5. A short range trajectory round according to claim 4, wherein the at least one segment means includes an extension member and a member overlapping the exterior peripheral surface of the plunger means, the plunger means having a recess in the forward portion thereof, the extension member of the at least one segment means and the recess of the plunger means having opposing surfaces correspondingly inclined with respect to the longitudinal axis of the round so that radial centrifugal force acting on the at least one segment means exerts an axial force on the plunger means for moving the plunger means from the forward position thereof at a predetermined time.

6. A short range trajectory round according to claim 5, wherein the extension member of the at least one segment means and the recess of the plunger means have one of a truncated shape and shape of a frustrum of a truncated pyramid.

7. A short range trajectory round according to one of claims 1, 2, 3, 4 or 5, further comprising sleeve means disposed within the cavity for lining the cavity, the plunger means being movable with respect to the sleeve means.

8. A short range trajectory round according to claim 7, further comprising at least one recess means at the rear portion of the round establishing a communication path between the base of the round and the cavity.

9. A short range trajectory round according to claim 8, wherein the cavity delimits a pressure reservoir space between the rear portin of the plunger means and the base of the round, the at least one recess means enabling the intake of gases into the pressure reservoir space.

10. A short range trajectory round according to claim 9, further comprising valve means for sealing the intake of the pressure reservoir space.

11. A short range trajectory round according to claim 10, wherein the valve means includes a check valve.

12. A short range trajectory round according to one of claims 2, 3, 4 or 5, further comprising flowoff canal means for enabling a time-controlled flowoff of gases from the area of the cavity behind the rear portion of the plunger means.

13. A short range trajectory round according to claim 12, wherein the flowoff canal means includes an axially-extending bore in the plunger means.

14. A short range trajectory round according to one of claims 1, 2, 3 or 4, further comprising at least one strap means surrounding the at least one segment means along the outer periphery thereof.

15. A short range trajectory round according to claim 14, wherein the strap means is responsive to force applied by the at least one segment means for breaking to enable outward movement of the portion of the at least one segment means.

16. A short range trajectory round according to claim 15, wherein the at least one strap means is a plastic member.

17. A short range trajectory round according to claim 4, wherein the mounting means includes a bracket extending along the periphery of the round at the rear portion thereof.

18. A short range trajectory round according to one of claims 1, 2, 3, 4 or 5, further comprising propellant charge means disposed at the rear portion of the round and auxiliary charge means disposed in the cavity for generating additional gases in the cavity upon ignition thereof.

19. A short range trajectory round according to claim 18, wherein the auxiliary charge means is responsive to the propellant gases generated upon firing of the round before being ignited.

20. A short range trajectory round according to one of claims 1, 2, 3, 4 or 5, wherein the at least one segment means delimits an axially-extending canal extending from the tip of the round to the cavity.

21. A short range trajectory round according to claim 20, further comprising sealing means disposed in the axially-extending canal, the sealing means being destroyed during flight of the round.

22. A short range trajectory round according to claim 17, wherein the bracket is a sabot.

23. A short range trajectory round having an aerodynamic resistance which sharply increases at a predetermined time after discharge of the round from a barrel of a weapon comprising a body having a longitudinal axis, at least one segment means forming a part of the body, at least a portion of the at least one segment means being arranged for outward movement away from the longitudinal axis, connector means cooperating with the at least one segment means for establishing a temporary connection between the at least one segment means and other portions of the body in response to the firing of the projectile to prevent movement of the portion of the at least one segment means away from the longitudinal axis of the round thereby to establish a first aerodynamic resistance for the round, and delay means for enabling termination of the temporary connection established by the connector means at a time after discharge of the round from the barrel of the weapon so as to enable outward movement of the portion of the at least one segment means with respect to the longitudinal axis of the round and thereby establish at least a second aerodynamic resistance for the round which is greater than the first aerodynamic resistance, and wherein the body is formed of a plurality of segment means configured to delimit an inner cavity within the body, the connector means being arranged within the cavity for establishing a temporary connection with the segment means in response to a force acting thereon and generated by the firing of the round.

24. A short range trajectory round according to claim 8, wherein the delay means include means for enabling a time-controlled reduction of the force acting on the connector means to establish the temporary connection of the connector means.

* * * * *